US005864073A

United States Patent [19]

Carlson

[11] Patent Number: 5,864,073

[45] Date of Patent: Jan. 26, 1999

[54] LAMINATED NECK FOR GUITARS, AND COMBINATION THEREOF WITH ADJUSTMENT SYSTEM

[75] Inventor: Mark R. Carlson, Minneapolis, Minn.

[73] Assignee: Fender Musical Instruments Corp., Scottsdale, Ariz.

[21] Appl. No.: 866,814

[22] Filed: May 30, 1997

[51] Int. Cl.[6] ..... G10D 3/00

[52] U.S. Cl. ..... 84/293; 84/314 R; 84/267

[58] Field of Search ..... 84/293, 267, 290, 84/452 P, 314 R

[56] References Cited

U.S. PATENT DOCUMENTS

| | | | |
|---|---|---|---|
| 4,084,476 | 4/1978 | Rickard | 84/293 |
| 4,137,813 | 2/1979 | Stone et al. | 84/314 |
| 4,145,948 | 3/1979 | Turner | 84/293 |
| 4,290,336 | 9/1981 | Peavey | 84/291 |
| 4,846,038 | 7/1989 | Turner | 84/293 |
| 4,846,039 | 7/1989 | Mosher | 84/293 |
| 5,189,235 | 2/1993 | Fishman et al. | 84/291 |
| 5,337,644 | 8/1994 | Fishman et al. | 84/314 |

*Primary Examiner*—William M. Shoop, Jr.
*Assistant Examiner*—Shih-yung Hsieh
*Attorney, Agent, or Firm*—Oppenheimer Wolff & Donnelly LLP

[57] ABSTRACT

An improved neck for a guitar which is comprised of a elongated body, an elongated fingerboard, and an elongated strip. The fingerboard is mounted longitudinally of the body on the upper side of the body. The strip is mounted in the neck longitudinally of the body and fingerboard and near the junction between the body and fingerboard and being substantially parallel to the junction. The strip has a modulus of elasticity greater than the body and fingerboard. The strip can have a domed upper surface and a flat bottom surface and may be adhesively secured to, or molded, to the fingerboard in a wide shallow groove formed in the bottom of the fingerboard. The strip and fingerboard may be laminated to the top surface of the neck body. The neck body may have a truss rod or lever system therein.

19 Claims, 2 Drawing Sheets

LAMINATED NECK FOR GUITARS, AND COMBINATION THEREOF WITH ADJUSTMENT SYSTEM

BACKGROUND OF THE INVENTION

Neck playability is a critical criterion in judging the quality of a guitar. It can be defined as the closest distance that the strings can be to the frets without there being any buzz (fret buzz) caused by a plucked string hitting any fret other than the one against which the string is pressed. An instrument with low action, namely a small distance from fret to string, is considered to have better playability.

Several external factors (and related forces) can produce detrimental effects on playability. These include:

1. Neck movements caused by expansion and contraction of the neck wood resulting from variations in moisture content of the wood.
2. Neck deflections resulting from string tension.
3. Neck movements resulting from any imperfections in the neck-adjustment mechanism (conventionally a truss rod).

These factors can occur during the manufacturing process, or after the instrument is in use.

Especially since wood is a highly unpredictable material, and since string tension forces vary across the fingerboard (fretboard) of the guitar, and since different truss rod systems can create different types of neck movements, it would be highly advantageous if the neck moved or deflected less than conventional prior-art necks do. It is here emphasized that the previous sentence relates primarily to wooden necks, which are generally desired because of their tonal qualities and their beauty.

The above-indicated factors, especially those stated in numbered paragraphs 1 and 2 above, are associated with forces that vary in location and can cause not only bending but twisting. Relative to twisting, the forces are not concentrated at the center of the neck, but instead (in the absence of the present invention) are generally much spread out and/or moved to different regions depending on what the piece of wood (from which the neck is formed) is, what condition the piece of wood is in, where the piece of wood was cut from the log, etc.

SUMMARY OF THE INVENTION

A purpose of the present invention is to stabilize the neck in such manner that the factors such as those stated above produce reduced effects on playability, and without sacrificing tonal qualities of the instrument.

In accordance with the present invention, a very stiff elongate element, having a certain cross-sectional shape, is laminated to the wood of the neck in a certain relationship to the neutral axis of the neck.

The stiff element is, at least in large part, generally dome shaped. This performs the special function that, under external forces, the natural strength of the arch concentrates the stresses at the center (width-wise) of the neck, along the length of the neck. At this center location, the truss rod or other neck-adjustment mechanism is best suited to compensate for these stresses. In response to internal moisture content forces, the domed shape distributes the forces to best resist bowing and twisting. The same is true of forces resulting from string tension.

The stiff element is made of what is known in the art as "graphite", by which is meant (in the present specification and claims) a combination of graphite (such as graphite fibers) and some matrix (such as epoxy synthetic resin).

In accordance with another important aspect of the invention, the stiff element is disposed as far as reasonably possible above the neutral axis of the neck. Thus, the dome is caused to extend into the fingerboard (fretboard), the latter being grooved or hollowed so as to snugly receive the dome.

The graphite is either molded or adhesively secured to the fretboard and/or to the wooden neck body therebeneath.

DETAILED DESCRIPTION OF EMBODIMENTS OF THE INVENTION

Figure 1:
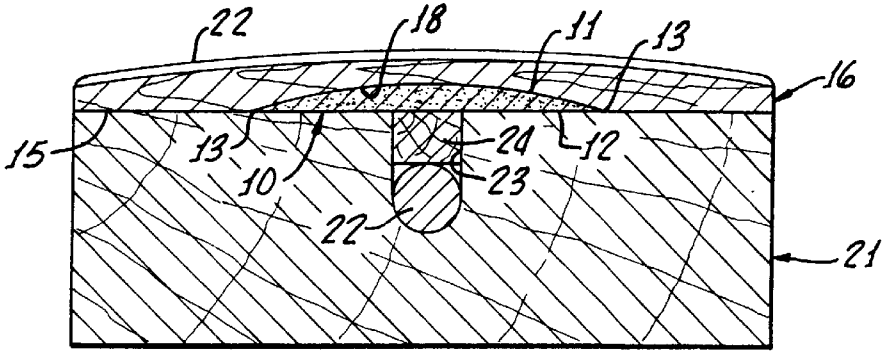
FIG. 1 is a cross-sectional view of a neck constructed in accordance with the invention, the section being taken relatively near the butt end (guitar body end) of the neck.
Figure 2:
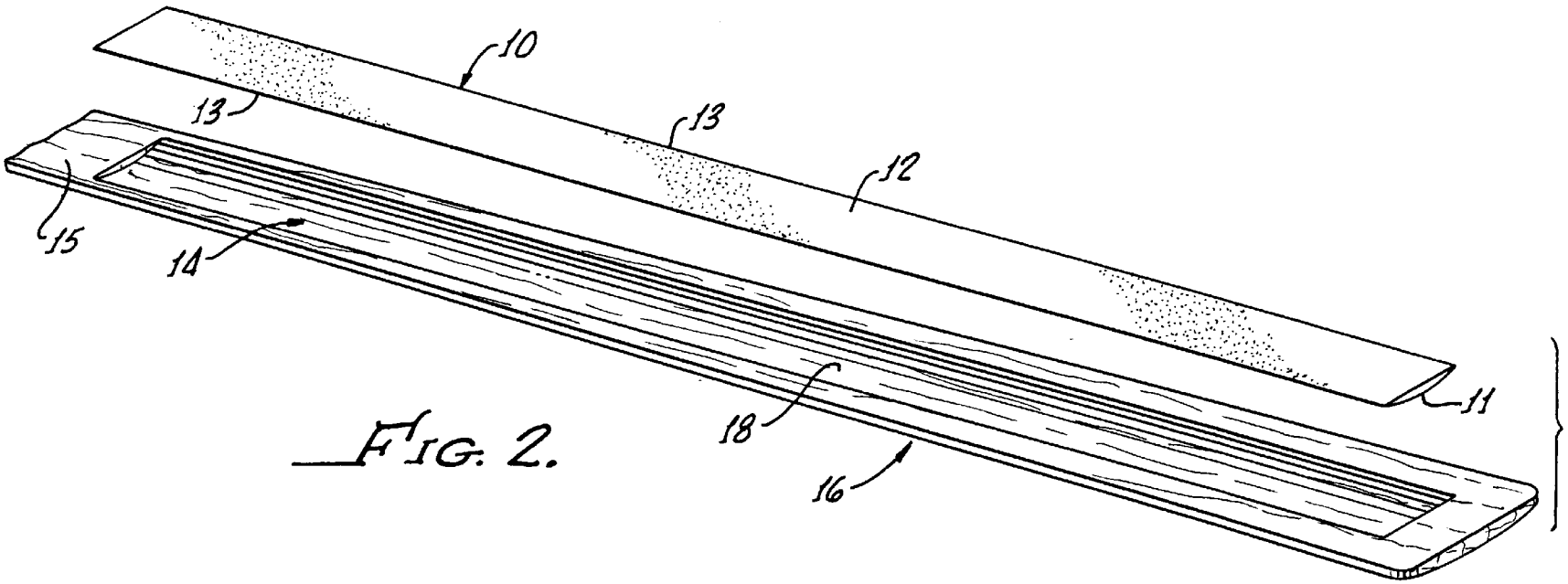
FIG. 2 is an exploded isometric view of the fingerboard and the graphite laminate, both inverted.
Figure 3:
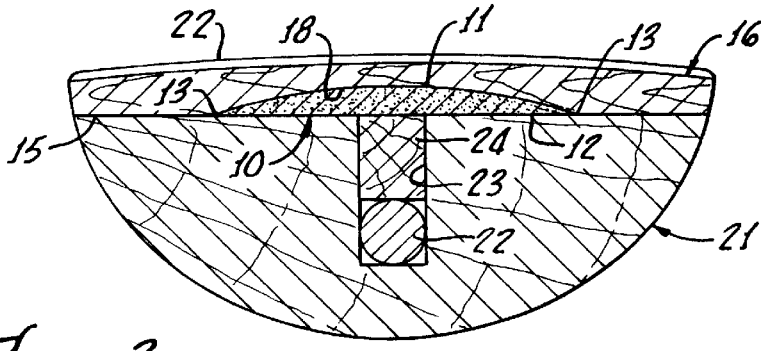
FIG. 3 is a cross-sectional view of the neck, taken relatively far from the butt end.

The use of the words guitar, guitars, guitarist, above and below (including in the claims) is not limiting. Such words relate also to electric bass guitars, mandolins, banjos, and other such musical instruments that are normally fretted.

The specification and drawings of U.S. Pat. No. 4,557,174 are hereby incorporated by reference herein. The present invention is (for example) incorporated into the neck set forth in the cited patent. Preferably, however, the present invention is employed in combination with the tension and lever system described an claimed in my U.S. patent application filed on even date herewith for a "Guitar Neck Incorporating Combination Lever and Tension-Compression Adjustment System". Said patent application is hereby incorporated by reference herein.

In accordance with one aspect of the invention, an elongate strip of stiff material is provided; it may be molded in place or adhesively secured. Stated more definitely, the stiff material is graphite or some other material having a modulus of elasticity ("M.E.") much greater than that of the surrounding wood. The M.E. of the graphite is at least 3 times greater, and preferably at least 4 times greater, than the M.E. of the surrounding wood.

It is a feature of the invention that the graphite strip may be small in cross-section and still accomplish much. The strip illustrated in the drawings has a cross-section area that is only a small fraction of the cross-sectional area of the illustrated conventional fingerboard. Stated in another way, the graphite strip shown in the drawings is only about half as wide as the fingerboard (and neck), and about half as thick (at the thickest part of the graphite strip) as the fingerboard would be if it were not grooved. The graphite strip is centered in a horizontal plane, being symmetrical about a vertical plane (called the medial longitudinal plane) that contains the longitudinal axis of the neck.

The graphite strip has a dome, or dome surface, on the upper side thereof and symmetrical about said medial longitudinal plane. The dome surface extends substantially the entire distance from one edge of the graphite strip to the other edge thereof.

The dome, or dome surface, tends to concentrate the stresses (or forces) in the center of the neck (width-wise), above the truss rod or other neck-adjustment mechanism.

The described graphite strip is numbered 10. Its dome surface is numbered 11. The other (bottom) surface is flat and is numbered 12. The edges have the number 13, and are preferably quite sharp.

In accordance with another aspect of the invention, strip 10 is laminated (or molded) so that it will be at a position as far as possible from the neutral axis of the neck. (The neutral axis is a horizontal axis, that is perpendicular to the medial longitudinal plane, and is such distances from the frets and from the extreme back of the neck that the bending stresses are zero at such neutral axis).

To accomplish the objective stated in the preceding paragraph, the graphite strip is laminated into a wide-shallow groove 14 that is formed in the bottom surface 15 of the fingerboard 16 for at least a large part of the length of the neck, and very preferably for the great majority of the length thereof.

The wall of groove 14 is numbered 18; it is shaped to mate closely with dome surface 11, as shown in FIG. 1, and is strongly adhesively secured therein by glue (not shown). As above indicated, the graphite may (alternatively) be molded into groove 14. The graphite bottom surface 12 is made flush with bottom surface 15 of the fingerboard.

Figure 4:
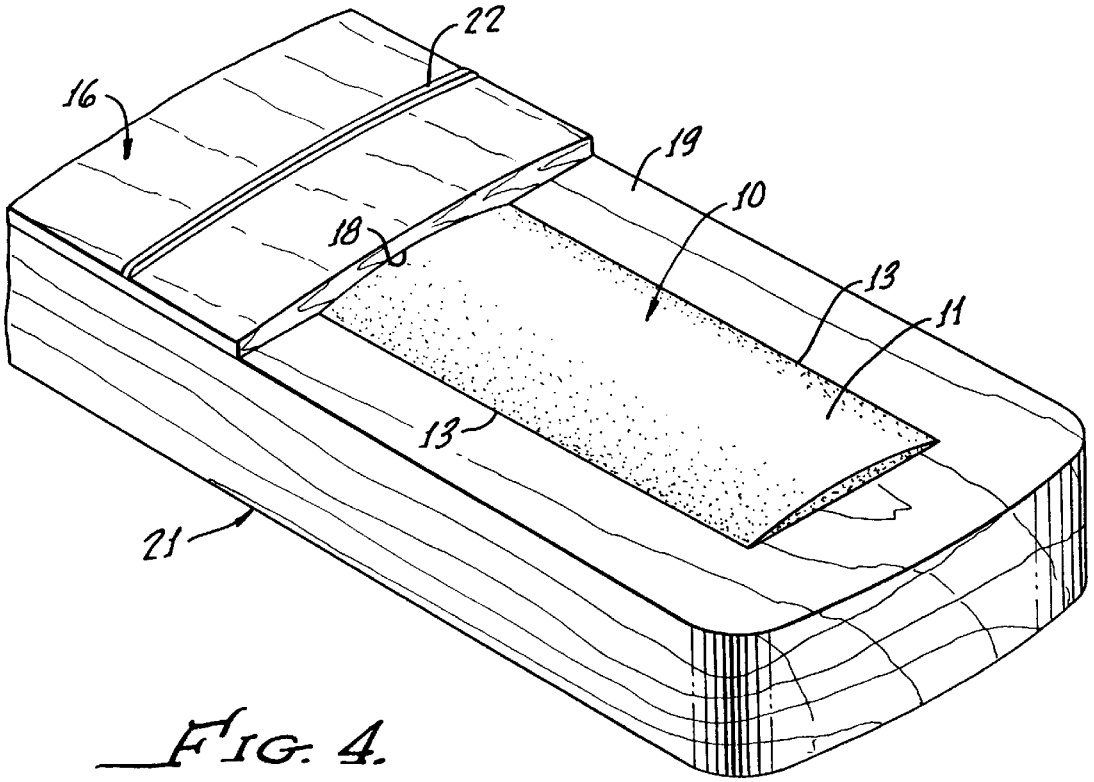
FIG. 4 is a fragmentary isometric view showing the neck body with the fingerboard thereon and the graphite protruding.

After the lamination of the fingerboard is completed, the resulting composite fingerboard is in turn laminated onto the top surface 19 of the neck body 21 (FIG. 4), in the conventional manner, by adhesive. Thus, the graphite strip is parallel to and adjacent to the junction between the body and the fingerboard.

In all respects other than the major one relating to the stated inclusion of the graphite laminate 10, and one relating (as below stated) to use of a fillet instead of a "skunk stripe" to partially fill the slot or groove for the adjustment element, the present neck is identical to the one shown and described in the cited patent. (The preceding sentence relates to the specification hereof, and does not limit claim coverage).

Thus, for example, there are frets 22 mounted on the upper side of the fingerboard 16, and a nut (not shown) mounted at the head end of such upper side.

The body 21 and fingerboard (fretboard) 16 are formed of suitable woods, typically maple for the body and rosewood for the fingerboard. Other woods may be used, for example mahogany or maple for the fingerboard.

The adjustment mechanism described in the cited patent includes a truss rod 22 that extends along the medial longitudinal plane of the neck, through a groove or slot 23 in such medial plane. Unlike the construction shown in the cited patent, however, the present construction preferably uses a fillet 24 to partially fill in the groove from above before the rosewood-graphite laminate is applied. (A groove 23 is formed in body 21 in the medial longitudinal plane, from the upper side of body 21. Then the truss rod 22 (and associated elements) is inserted into the groove, following which the fillet 24 is mounted in the upper portion of the groove and securely glued in place. The rosewood-graphite laminate is then securely glued in place).

As above stated, it is preferred that the tension and lever system described and shown in my U.S. patent application filed on even date herewith be used instead of the truss rod system of the cited patent. Both the truss rod and the lever system are adjustment mechanisms for the neck.

Operation, Summary, and Statement of Additional Advantages

After the neck is manufactured as described above, and by adding hardware, it is mounted on a guitar body and strings are mounted thereover. Then, a technician at the factory adjusts the truss rod (or lever system) to achieve maximum playability. This is all done in the same manner as in the prior art, with the important exception that after the neck is adjusted it will typically maintain its desired playability for a relatively long time. Then, when the musician does desire to make an adjustment after purchase of the instrument, the amount of adjustment necessary will be reduced in comparison to prior art wooden necks. With reduced adjustment, the neck tends to have a better shape.

To summarize and augment some advantages of the present invention, the graphite laminate takes a very large proportion of the load that is created by string tension, etc.

There need be only a small cross-sectional area of graphite, yet high neck stiffness is attained. Because there need not be much graphite, there is more wood remaining (for tone) and the cost of the graphite is reduced.

The behavior of the neck is made, because of the present invention, more consistent. There are more control and consistency of tonal characteristics of the neck.

The graphite laminate, with its dome shape, provides the stability of the arch, and concentrates stress at the widthwise center of the neck—along substantially the entire length of the neck. The stresses are brought to where they can best be compensated for by the truss rod (or lever) system.

The laminate, being preferably built into the fingerboard, is remote from the neutral axis, is very effective, and can be manufactured as part of the fingerboard and subsequently applied to the neck body (just as if there were no graphite).

The foregoing detailed description is to be clearly understood as given by way of illustration and example only, the spirit and scope of this invention being limited solely by the appended claims.

What is claimed is:

1. A neck for a guitar, which comprises:

(a) an elongate neck body, (b) an elongate fingerboard mounted on an upper side of said body longitudinally of said body, and (c) an elongate strip of graphite mounted in said fingerboard longitudinally of said body and of said fingerboard, said graphite strip being near a junction between said body and said fingerboard and being substantially parallel to said junction.

2. The invention as claimed in claim 1, in which said neck body and fingerboard are both made of wood, and in which said neck body and fingerboard are laminated to each other.

3. The invention as claimed in claim 2, in which the modulus of elasticity of said graphite is at least 3 times greater than the modulus of elasticity of the wood surrounding said strip of graphite.

4. The invention as claimed in claim 2, in which the modulus of elasticity of said graphite is at least 4 times greater than the modulus of elasticity of the wood surrounding said strip of graphite.

5. The invention as claimed in claim 2, in which a neck-adjustment mechanism is incorporated in said neck body.

6. The invention as claimed in claim 2, in which said strip of graphite is disposed in a recess in an underside of said fingerboard.

7. The invention as claimed in claim 2, in which said fingerboard has a wide shallow groove in an underside thereof, and in which said strip of graphite is mounted in said groove and substantially entirely fills said grove.

8. The invention as claimed in claim 7, in which the upper side of said strip of graphite is dome shaped in cross-section, and in which the wall of said groove is correspondingly dome shaped in cross-section, and is adjacent said upper side, said groove wall and said upper side of said strip being bonded to each other, and in which said strip of graphite is symmetrical about the medial longitudinal plane of said neck.

9. The invention as claimed in claim 7, in which said strip of graphite has a cross-sectional area that is only a small fraction of a cross-sectional area of said fingerboard.

10. The invention as claimed in claim 8, in which said strip of graphite has a cross-sectional area that is only a small fraction of the cross-sectional area of said fingerboard.

11. The invention as claimed in claim 7, in which said strip of graphite is about half as wide and about half as thick as said fingerboard.

12. The invention as claimed in claim 8, in which said strip of graphite is about half as wide and about half as thick as said fingerboard.

13. A guitar neck, which comprises:

(a) an elongate neck body formed of wood, said neck body having an upper side, (b) an elongate fingerboard formed of wood, said fingerboard having a lower side that has a wide shallow groove therein, (c) an elongate strip of stiff material having a modulus of elasticity much greater than the modulus of elasticity of said wood, said strip being shaped to fit in said groove, said lower side of said fingerboard being laminated to said upper side of said neck body.

14. The invention as claimed in claim 13, in which said modulus of elasticity of said strip is at least 3 times greater than the modulus of elasticity of said wood surrounding said strip.

15. The invention as claimed in claim 13, in which said strip is symmetrical about a medial longitudinal plane of said neck.

16. The invention as claimed in claim 15, in which the upper surface of said strip is dome shaped in cross-section.

17. The invention as claimed in claim 16, in which a neck-adjustment mechanism is mounted in said neck body, generally in the medial longitudinal plane of said neck.

18. The invention as claimed in claim 17, in which said strip has a bottom surface that is flush with said lower side of said fingerboard, and in which said bottom surface is laminated to said upper side of said neck body.

19. The invention as claimed in claim 18, in which said bottom surface and lower side and upper side are generally coplanar.

* * * * *